US007876303B2

(12) United States Patent
Moon et al.

(10) Patent No.: US 7,876,303 B2
(45) Date of Patent: Jan. 25, 2011

(54) METHOD AND APPARATUS FOR DRIVING DATA IN LIQUID CRYSTAL DISPLAY PANEL

(75) Inventors: Kook Chul Moon, Gyeonggi-do (KR); Jun Young Lee, Gyeonggi-do (KR); Ung Sik Kim, Gyeonggi-do (KR); Seock Cheon Song, Gyeonggi-do (KR); Sang Hoon Lee, Seoul (KR); Keun Woo Park, Seoul (KR); Ho Suk Maeng, Gyeonggi-do (KR); Sung Wook Kang, Seoul (KR); Pil Mo Choi, Seoul (KR)

(73) Assignee: Samsung Electronics Co., Ltd. (KR)

( * ) Notice: Subject to any disclaimer, the term of this patent is extended or adjusted under 35 U.S.C. 154(b) by 1239 days.

(21) Appl. No.: 11/440,275

(22) Filed: May 24, 2006

(65) Prior Publication Data

US 2007/0146155 A1 Jun. 28, 2007

(30) Foreign Application Priority Data

Nov. 30, 2005 (KR) ..... 10-2005-0115197

(51) Int. Cl.
*G09G 3/36* (2006.01)

(52) U.S. Cl. ..... 345/100; 345/87; 345/204

(58) Field of Classification Search ..... 345/204–205, 345/211–215, 38, 50–111
See application file for complete search history.

(56) References Cited

U.S. PATENT DOCUMENTS

| | | | | |
|---|---|---|---|---|
| 2004/0017345 | A1* | 1/2004 | Lee | 345/87 |
| 2004/0257351 | A1* | 12/2004 | Ishii | 345/204 |
| 2005/0117384 | A1 | 6/2005 | Tsuda et al. | |
| 2006/0012595 | A1* | 1/2006 | Chen et al. | 345/207 |

FOREIGN PATENT DOCUMENTS

| | | | |
|---|---|---|---|
| CN | 1652194 | A | 8/2005 |
| JP | 2003-195834 | | 7/2003 |
| JP | 2005-157217 | A | 6/2005 |
| JP | 2005-164705 | | 6/2005 |
| KR | 2004-048447 | | 6/2004 |
| KR | 2005-052396 | | 6/2005 |

* cited by examiner

*Primary Examiner*—Alexander Eisen
*Assistant Examiner*—Christopher E Leiby
(74) *Attorney, Agent, or Firm*—Innovation Counsel LLP

(57) ABSTRACT

A method and apparatus for driving the data in a liquid crystal display (LCD) panel are presented. The method and apparatus prevent or reduce defects at the boundary between pixel blocks when the pixel blocks are sequentially driven on a block-by-block basis. The method includes applying data signals to a first data block, precharging a second data block that is adjacent to the first data block to a predetermined precharge voltage, and applying data signals to the second data block. The precharging prevents a large voltage difference at the boundary, thereby reducing defects.

5 Claims, 4 Drawing Sheets

METHOD AND APPARATUS FOR DRIVING DATA IN LIQUID CRYSTAL DISPLAY PANEL

CROSS-REFERENCE TO RELATED APPLICATION

This patent application claims priority from Korean Patent Application No. 2005-0115197 filed on Nov. 30, 2005, the content of which is incorporated by reference herein in its entirety.

BACKGROUND OF THE INVENTION

1. Field of the Invention

The present invention relates to a liquid crystal display (LCD) device, and more particularly, to a method and apparatus for driving the data in an LCD panel.

2. Description of the Related Art

A typical LCD device displays an image on an image display unit via liquid crystal cells arranged in a matrix format by controlling light transmittance in response to a video signal. An active-matrix LCD device, in particular, uses a thin film transistor (TFT), which is a well-known switching element, to drive the pixels. The TFT utilizes an amorphous silicon (a-Si) thin film or a low temperature polycrystalline silicon (LTPS) thin film. The LTPS thin film, which is formed by crystallizing the a-Si thin film by a laser annealing method, allows a driving circuit of the image display unit to be mounted on a substrate because the LTPS thin film shows high electron mobility and can achieve a highly integrated circuit.

The LCD device where the LTPS thin film is used and the driving circuit is mounted on the substrate supplies data to the image display unit by a block sequential driving method. When using the block sequential driving method, the LCD device using the LTPS thin film splits data lines into a plurality of blocks and drives the data lines sequentially, block-by-block, during one horizontal period. However, in the block-based sequential driving method, a data voltage charged to a pixel electrode connected to the last data line of each block varies by the interference of a data signal supplied to the first data line of the next block during a data charge of the next block and therefore picture quality degradation occurs from a block boundary.

Hereinafter, description of how the block boundary is generated in a conventional block sequential driving method will be provided with reference to FIG. 1.

FIG. 1 is a circuit diagram illustrating a part of a TFT substrate of a conventional LCD panel using an LTPS thin film, focusing on a data driver. The LCD panel includes a data driver 10 mounted therein with shift registers SRm and SRm+1 and sampling blocks SBm and SBm+1 for sequentially driving blocks of data lines DLm1 . . . DLmn and DL(m+1)1 . . . DL(m+1)n of an image display unit 20.

The image display unit 20 includes pixel electrodes 12 formed at subpixel regions defined by the intersections of gate lines GLi and GLi+1 and the data lines DLm1 to DL(m+1)n, and TFTs for independently driving the pixel electrodes 12. The gate lines GLi and GLi+1 are sequentially driven by a gate driver (not shown) mounted on the LCD panel. The data lines DLm1 . . . DLmn and DL (m+1)1 . . . DL(m+1)n are sequentially driven block-by-block every horizontal period during which the gate lines GLi and GLi+1 are driven and charge data signals supplied through the data driver 10. The TFTs maintain the data signals of the data lines DLm1 . . . DLmn and DL(m+1)1 . . . DL(m+1)n by charging them to the voltage of the pixel electrodes 12 in response to scan signals of the gate lines GLi and GLi+1.

The data driver 10 sequentially drives the data lines DLm1 . . . DLmn and DL(m+1)1 . . . DL(m+1)n of the image display unit 20 in blocks PBm, PBm+1 and supplies data signals D1 to Dn transmitted through data buses B1 to Bn to the pixel blocks PBm and PBm+1. The m-th and (m+1)-th shift registers SRm and SRm+1 of the data driver 10 sequentially provide sampling control signals. S ampling switches SW1, SW2, . . . SWn of the m-th sampling block SBm perform sampling of the n data signals D1, D2, . . . Dn supplied through the n data buses B1, B2, . . . Bn in response to the sampling control signals of the m-th shift register SRm, and charge the sampled signals to the n data lines DLm1 to DLmn of the m-th pixel block PBm. Th en the TFTs of the m-th pixel block PBm that are tumed on by the driving of the gate lines GLi and GLi+1 charge the data lines DLm1 to DLmn to the pixel electrodes 12. The (m+1)-th shift register and sampling block SRm+1 and SBm+1 are identically driven to perform sampling of the n data signals D1 to Dn supplied through the data buses B1 to Bn and charge the sampled signals to the data lines DL(m+1)1 to DL(m+1)n of the (m+1)-th pixel block PBm+1. Then the TFTs of the (m+1)-th pixel block PBm+1 that are turned on by the driving of the gate lines GLi and GLi+1 charge the data lines DL(m+1)1 to DL(m+1)n to the pixel electrodes 12.

When the data signals are charged to the data line DL(m+1)1 to DL(m+1)n of the (m+1)-th pixel block PBm+1, the data signal to the pixel electrode 12 that is connected to the last data line DLmn of the m-th pixel block PBm varies by the interference of the data signal charged to the first data line DL(m+1)1 of the (m+1)-th pixel block PBm+1. This is caused by a coupling of a parasitic capacitance Cp formed between the pixel electrode 12 connected to the last data line DLmn of the m-th pixel block PBm and the first data line DL(m+1)1 of the (m+1)-th pixel block PBm+1. Therefore, a defect is generated at a boundary between the m-th pixel block PBm and the (m+1)-th pixel block PBm+1.

SUMMARY OF THE INVENTION

The present invention provides a method and apparatus for driving the data in an LCD panel. The method and apparatus are capable of reducing or eliminating defects in the inter-block boundary during sequential driving of pixel blocks.

In one aspect, the present invention is a method of driving the data for an LCD panel including a plurality of data blocks, each of the data blocks having n (where n is any natural number) data lines. The method entails applying data signals to a first data block, precharging the first data line of a second data block to a predetermined voltage, wherein the second data block is adjacent to the first data block, and applying data signals to the second data block.

The predetermined voltage may be the same as the voltage of a data signal supplied to the first data line of the second data block during the applying of data signals to the second data block.

Applying data signals may entail inputting n data signals to be supplied to the n data lines, inputting the predetermined voltage, generating a sampling control signal corresponding to each data block, and sampling the n data signals and the predetermined voltage in response to the sampling control signal.

The method may also entail generating a direction selection signal for determining a sequential driving direction of the plurality of data blocks. The applying of the data signals may further include selecting a data line to apply the predetermined voltage to according to the direction selection signal. The data line selection, in turn, may include selecting a data line to apply the predetermined voltage to by using the sampling control signal of each of the first and second data blocks together with the direction selection signal. The plurality of data blocks may be sequentially driven block by block in a forward or backward direction according to the direction selection signal, and wherein the second data block is adjacent to the first data block.

In another aspect, the present invention is an apparatus for driving the data for an LCD panel. The apparatus includes the liquid crystal display panel and a data driver. The liquid crystal display panel includes a plurality of data blocks, wherein each of the data blocks has n (where n is any natural number) data lines. The data driver is for precharging the first data line of a second data block with a predetermined voltage, wherein the second data block is adjacent to a first data block when data signals are applied to the first data block of the liquid crystal display panel. The predetermined voltage may be the same as the voltage of a data signal that is supplied to the first data line of the second data block when data signals are applied to the second data block.

The data driver may include n data buses for providing n data signals to be supplied to the n data lines and an auxiliary data bus for providing the predetermined voltage, a plurality of shift registers for providing sampling control signals corresponding to the data blocks, and a plurality of sampling switch blocks for sequentially driving the plurality of data blocks in response to the sampling control signals and precharging the predetermined voltage to the first data line of an adjacent block.

Each of the plurality of sampling switch blocks may include n sampling switches for connecting the n data buses to n data lines of a corresponding data block in response to a corresponding sampling control signal, and a precharge sampling switch for connecting the auxiliary data bus to the first data line of an adjacent block in response to the corresponding sampling control signal.

The plurality of shift registers may be driven in a forward or backward direction according to a direction selection signal. Each of the plurality of sampling switch blocks includes n sampling switches for connecting the n data buses to n data lines of a corresponding data block in response to a corresponding sampling control signal, and a precharge circuit for selecting a data line of a next block to apply the predetermined voltage to according to the direction selection signal. The precharge circuit selects a data line to precharge the predetermined data signal by using sampling control signals of the first and second data blocks together with the direction selection signal.

The precharge circuit may have a first sampling switch connected to the first data line of the second data block adjacent to the first data block, a second sampling switch connected to the first data line of the first data block adjacent to the second data block, and a precharge controller for connecting any one of the first and second sampling switches to the data auxiliary bus by using first and second sampling control signals corresponding respectively to the first and second data blocks and the direction selection signal.

The precharge controller may have a first NAND operator for performing a NAND operation on the first sampling control signal and the direction selection signal, a first inverter for inverting the output of the first NAND operator and controlling the second sampling switch, a second inverter for inverting the direction selection signal, a second NAND operator for performing a NAND operation on an inverted direction selection signal passing through the second inverter and the second sampling control signal, and a third inverter for inverting the output of the second NAND operator and controlling the first sampling switch.

BRIEF DESCRIPTION OF THE DRAWINGS

The above objects, features and advantages of the present invention will become more apparent from the following detailed description when taken in conjunction with the accompanying drawings in which.

DETAILED DESCRIPTION OF THE EMBODIMENTS

The exemplary embodiments of the present invention will now be described with reference to the attached drawings.

Figure 1:
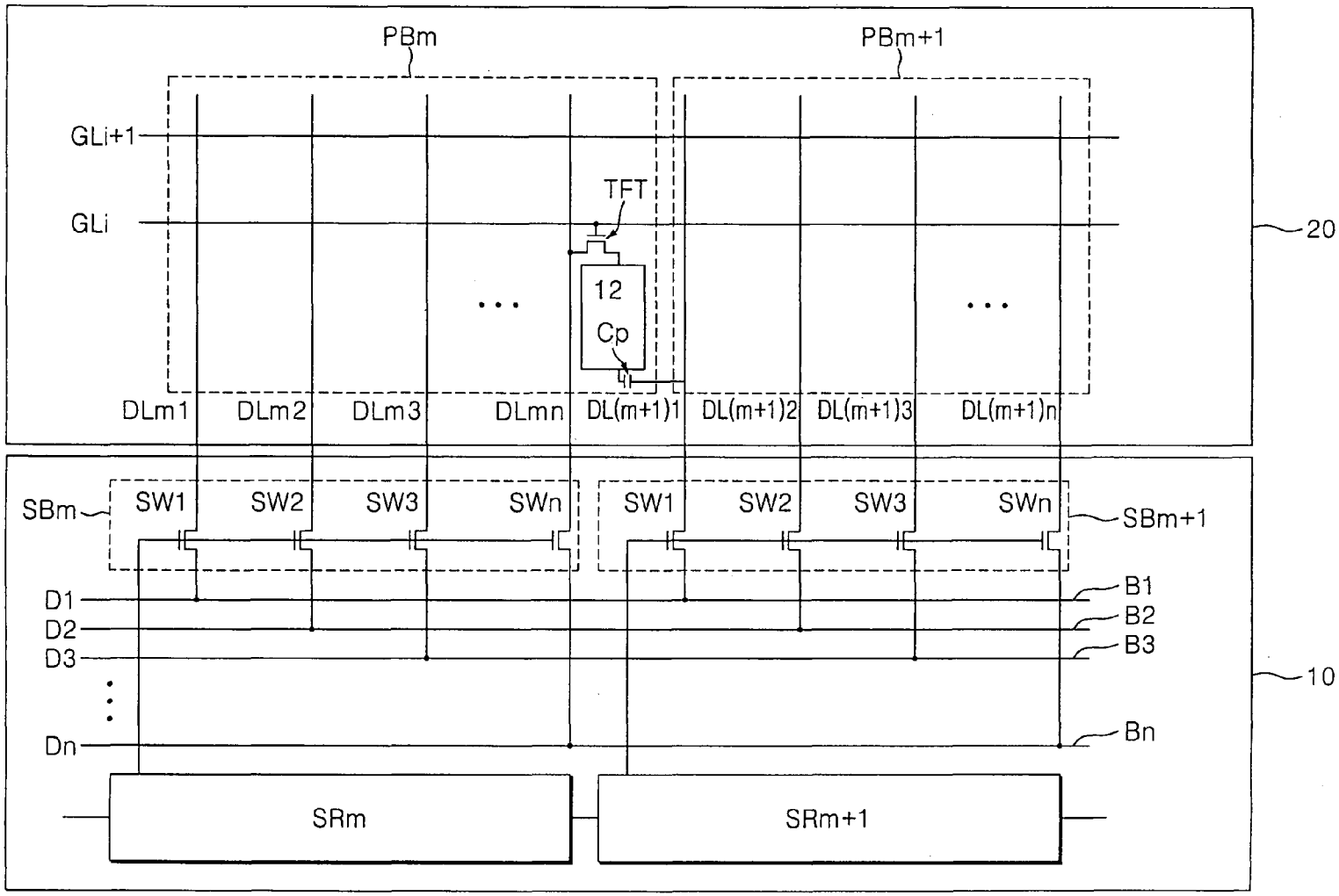
FIG. 1 PRIOR ART
FIG. 1 is a circuit diagram of a data driver of an LCD panel according to the prior art.
Figure 2:
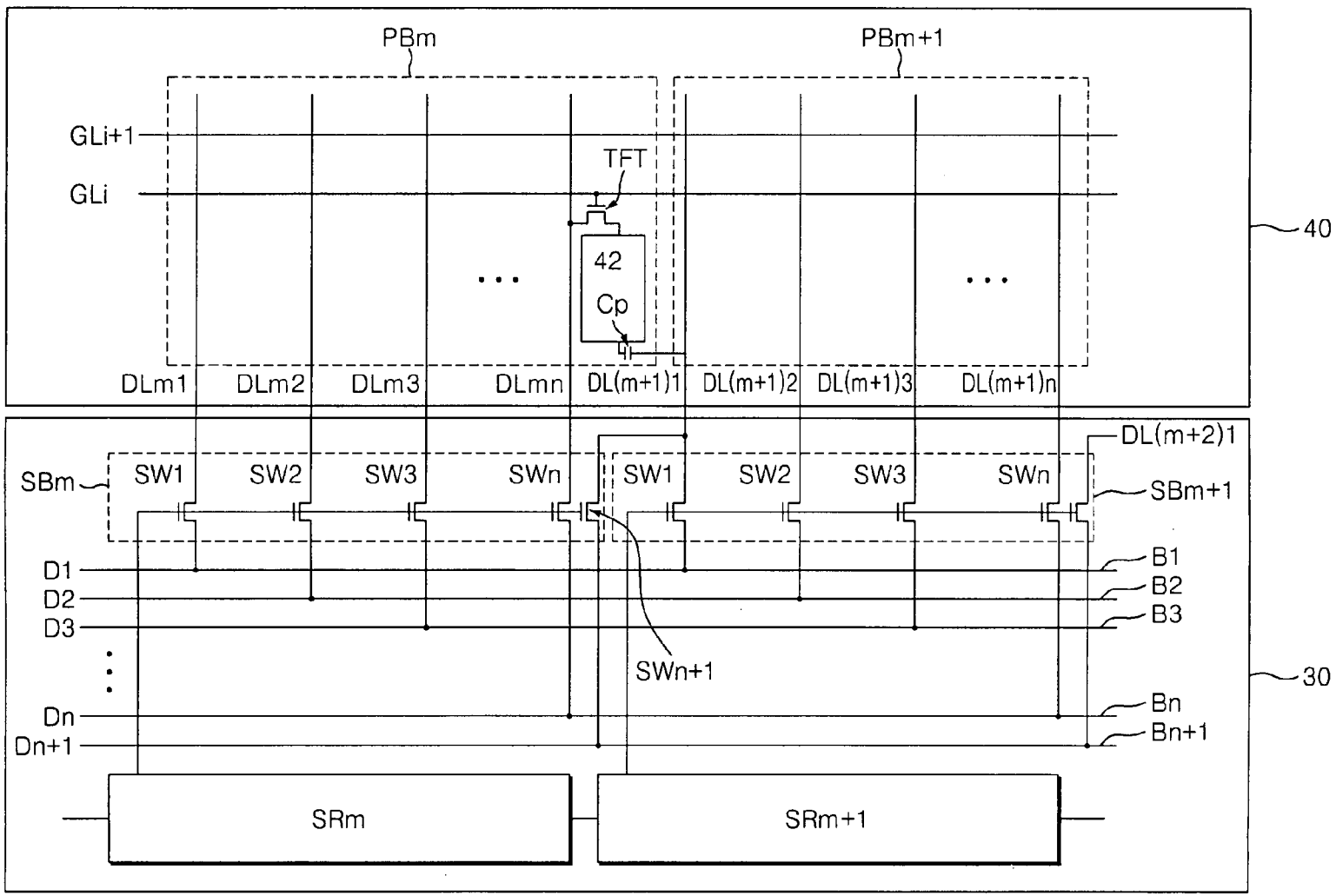
FIG. 2 is a circuit diagram of a data driver of an LCD panel according to an exemplary embodiment of the present invention.

FIG. 2 is a circuit diagram of an exemplary equivalent circuit illustrating the part of a TFT substrate where a data driver of an LCD panel is mounted.

The LCD panel includes a data driver 30 mounted therein with shift registers SRm and SRm+1 and sampling blocks SBm and SBm+1 for sequentially driving data lines DLm1 . . . DLmn and DL(m+1)1 . . . DL(m+1)n of an image display unit 40 on a block-by-block basis.

The image display unit 40 includes pixel electrodes 42 formed in subpixel regions defined by the intersections of gate lines GLi and GLi+1 and the data lines DLm1 . . . DLmn and DL(m+1)1 to DL(m+1)n, and TFTs for independently driving the pixel electrodes 42. The gate lines GLi and GLi+1 are sequentially driven by a gate driver (not shown) mounted on the LCD panel. The data lines DLm1 . . . DLmn and DL(m+1)1 . . . DL(m+1)n are sequentially driven in blocks PBm and PBm+1 every horizontal period during which the gate lines GLi and GLi+1 are driven and transmit data signals supplied through the data driver 30. The TFTs maintain the data signals of the data lines DLm1 . . . DLmn and DL(m+1)1 . . . DL(m+1)n by applying them to the pixel electrodes 42 in response to scan signals from the gate lines GLi and GLi+1.

When data signals are applied to the data lines DLm1 to DLmn of the m-th pixel block PBm, the first data line DL(m+1)1 of the (m+1)-th pixel block PBm+1 that is closest to the m-th pixel block PBm is precharged. The precharging is done at a voltage level that will be used to drive the (m+1)-th pixel block PBm+1. In other words, when charging the (m+1)-th pixel block PBm+1 after the m-th pixel block PBm is charged, the same data signal that was used for the precharge of pixel block PBm+1 when the m-th pixel block PBm was driven is supplied to the first data line DL(m+1)1 of the (m+1)-th pixel block PBm+1. Therefore, the first data line DL(m+1)1 of the (m+1)-th pixel block PBm+1 maintains the precharged voltage that it received when the m-th pixel block PBm was being charged. This way, because there is no change in the voltage that is applied to the pixel block PBm+1 when the sequential driving moves from pixel block PBm to pixel block PBm+1, the signal interference affecting the pixel electrode 42 of the adjacent m-th pixel block PBm is reduced. As a result, the change in the voltage of the pixel electrode 42 positioned near a boundary between two neighboring pixel blocks PBm, PBm+1is less drastic or even eliminated when the (m+1)-th pixel block PBm+1 is charged. As a shift in the voltage of the pixel electrode 42 is largely responsible for the defect at the block boundary, the defect rate at the boundary between the pixel blocks PBm and PBm+1 is reduced.

The data driver 30 includes n data buses BI to Bn for providing n data signals D1 to Dn to the pixel blocks PBm and PBm+1. In addition, the data driver 30 includes an (n+1)-th data bus Bn+1 for supplying an (n+1)-th data signal Dn+1to the first data line of the next pixel block during the precharge process. The data driver 30 also includes the shift registers SRm and SRm+1 and sampling blocks SBm and SBm+1 for sequentially driving the pixel blocks PBm and PBm+1.

The m-th and (m+1)-th shift registers SRm and SRm+1 of the data driver 30 sequentially supply sampling control signals. The m-th sampling block SBm includes (n+1) sampling switches SW1 . . . SWn+1 that are simultaneously turned on in response to the sampling control signal of the m-th shift register SRm. Th e first to n-th sampling switches SW1 to SWn sample the data signals D to Dn from the n data buses B1 to Bn and apply the sampled signals to the n data lines DLm1 . . . DLmn of the m-th pixel block PBm, respectively. During the precharge process, the (n+1)-th sampling switch SWn+1 applies the data signal Dn+1 that is supplied through the (n+1)-th data bus Bn+l to the first data line DL(m+1)1 of the (m+1)-th pixel block PBm+1. In this case, the voltage of the data signal that will be used to drive the first data line DL(m+1)1 when the (m+1)-th pixel block PBm+1 is driven is used as the precharge voltage.

The (m+1)-th sampling block SBm+1 includes (n+1) sampling switches SW1 to SWn+1 that are simultaneously turned on in response to the sampling control signal of the (m+1)-th shift register SRm+1. The first to n-th sampling switches SW1 to SWn sample the data signals D1 to Dn supplied through the n data buses B1 to Bn and charge the sampled signals to the n data lines DL(m+1)1 to DL(m+1)n of the (m+1)-th pixel block PB(m+1). The (n+1)-th sampling switch SWn+1 precharges the data signal Dn+1 supplied through the (n+1)-th data bus Bn+1 to the first data line DL(m+2)1 of the next pixel block PBm+2 (not shown). The sa me data signal as the precharge voltage that was applied when the m-th pixel block PBm was driven is applied to the first data line DL(m+1)1 of the (m+1)-th pixel block PBm+1. In other words, the same data signal is applied to the first data line DL(m+1)1 of the (m+1)-th pixel block PBm+1 when the m-th and (m+1)-th pixel blocks PBm and PBm+1are driven. A timing controller (not shown) supplies data to the data buses B1 to Bn+1. More specifically, the timing controller supplies the first data signal D1 through the first data bus B1 when the (m+1)-th pixel block PBm+1 is driven. Likewise, the precharge data signal Dn+1 is supplied to the (n+1)-th data bus Bn+1 when the m-th pixel block PBm is driven. Therefore, the first data line DL(m+1)1 of the (m+1)-th pixel block PBm+1maintains the precharge voltage that was applied when the m-th pixel block PBm was driven. There is no change in the voltage, and the signal interference affecting the pixel electrode 42 of the adjacent m-th pixel block PBm is reduced. As a result, the change in the voltage of the pixel electrode 42 positioned near a boundary between two neighboring pixel blocks PBm, PBm+1 is less drastic or even eliminated when the (m+1)-th pixel block PBm+1 is charged. As a shift in the voltage of the pixel electrode 42 is largely responsible for the defect at the block boundary, the defect rate at the boundary between the blocks is reduced.

If the (m+1)-th pixel block PBm+1 were the last pixel block of the LCD panel, the (m+1)-th sampling block SBm+1 would include only n sampling switches SW1 to SWn without an (n+1)-th sampling switch SWn+1.

Figure 3:
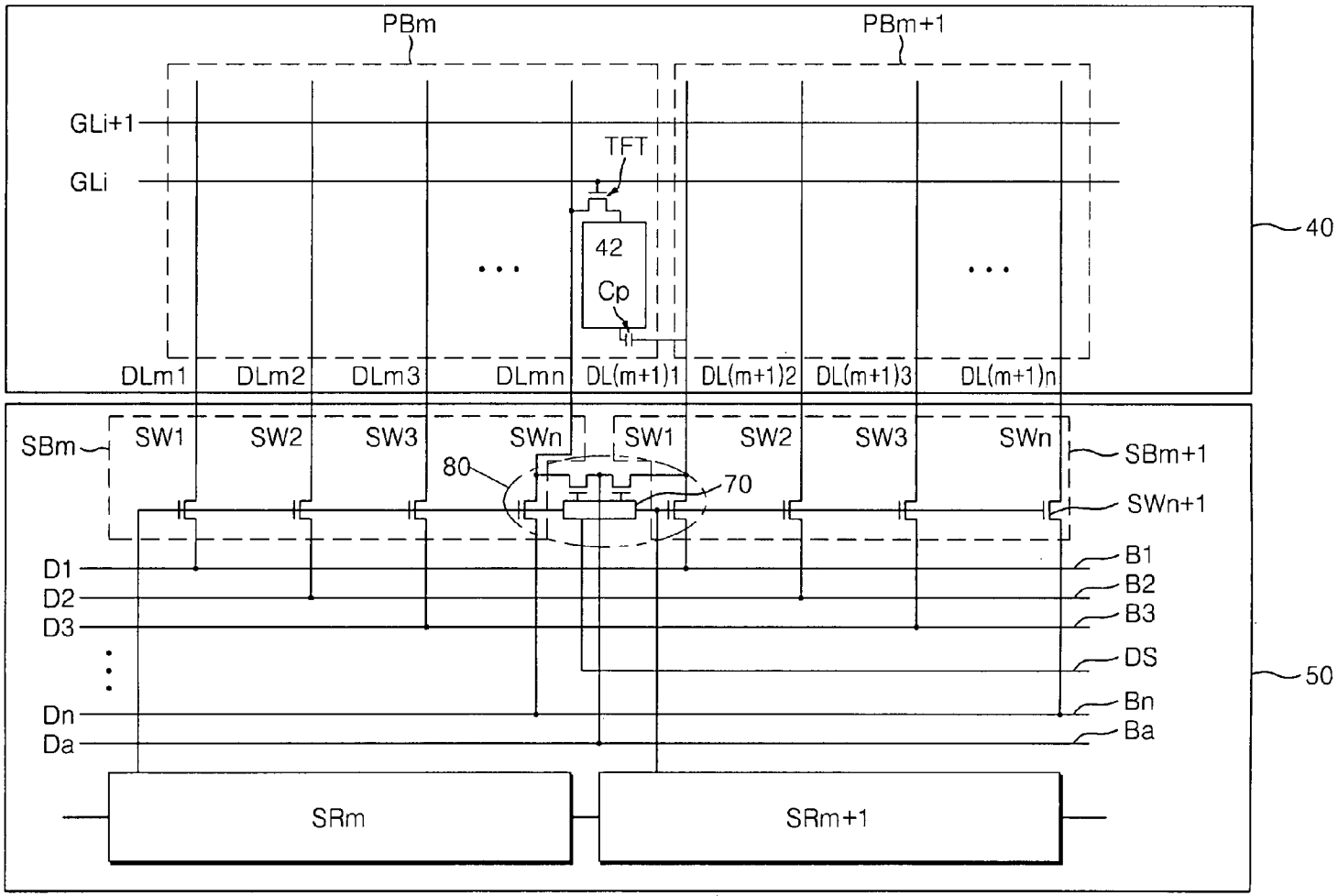
FIG. 3 is a circuit diagram of a data driver of an LCD panel according to another exemplary embodiment of the present invention.

FIG. 3 is a circuit diagram of another exemplary equivalent circuit illustrating the part of a TFT where a data driver of an LCD panel is mounted.

A data driver 50 shown in FIG. 3 has substantially the same constituent elements as the data driver 30 shown in FIG. 2 except that a precharge circuit 80 is additionally provided to select a data line to be precharged. The selection is made by using shift registers SRm and SRm+1 sequentially driven in both directions. Description of the elements that were described above will not be repeated for this embodiment.

The data lines DLm1 to DL(m+1)n are sequentially driven in blocks PBm and PBm+1 every horizontal period during which the gate lines GLi and GLi+1 are driven and data signals are supplied through the data driver 50. The TFTs maintain the data signals supplied sequentially to the data lines DLm1 to DL(m+1)n by applying them to the pixel electrodes 12 in response to the scan signals from the gate lines GLi and GLi+1.

The m-th and (m+1)-th pixel blocks PBm and PBm+1 of the image display unit 40 may be sequentially driven in a forward or backward direction. In the forward sequential driving, the first data line DL(m+1)1 of the (m+1)-th pixel block PBm+1 is precharged when data signals are applied to the data lines DLm1 to DLmn of the m-th pixel block PBm. When applying data signals to the data lines DL(m+1)1 to DL(m+1)n of the (m+1)-th pixel block PBm+1, the data signal that is supplied to the first data line DL(m+1)1 is the same as the precharge voltage that was applied when the m-th pixel block PBm was being driven. In the backward sequential driving, when data signals are applied to the data lines DL(m+1)1 to DL(m+1)n of the (m+1)-th pixel block PBm+1, the last data line DLmn of the m-th pixel block PBm that is closest to the (m+1)-th pixel block PB+1 is precharged. When data signals are applied to the data lines DLm1 to DLm of the m-th pixel block PBm, the data signal that is supplied to the data line DLmn is the same as the precharge voltage that was applied when the data (m+1 )-th pixel block PBm+1 was being driven. Sinc e the respective pixel blocks PBm and PBm+1 precharge a data line in an adjacent pixel block to the current pixel block during the forward and backward driving, the amount of voltage change experienced by the pixel electrode 42 positioned at an edge of each pixel block is minimized. Hence, the defect rate in the boundary region between the blocks is reduced.

The data driver 50 includes n data buses BI to Bn for supplying n data signals D1 to Dn to be supplied to the respective pixel blocks PBm and PBm+1. The data driver further includes an auxiliary data bus Ba for supplying an auxiliary data signal Da to the first data line of the next pixel block. The data driver 50 also includes shift registers SRm and SRm+1 and sampling blocks SBm and SBm+1 for sequentially driving the pixel blocks PBm and PBm+1 in forward and backward directions. The data driver 50 also includes the precharge circuit 80 connected between the sampling blocks SBm and SBm+1 for selecting a driving direction of the shift registers SRm and SRm+1. The driving direction of the shift registers SRm, SRm+1, which is indicated by a selection signal DS, determines which data line is to be precharged. The precharge circuit 80 includes a forward sampling switch SWf and a backward sampling switch SWb controlled by a precharge controller 70 using a sampling control signal of the shift registers SRm and SRm+1 and the direction selection signal DS.

The m-th and (m+1)-th shift registers SRm and SRm+1 of the data driver 50 sequentially supply the sampling control signal in a forward or backward direction in response to the direction selection signal DS. In the forward driving mode, n sampling switches SW1 to SWn of the m-th sampling block SBm are simultaneously turned on in response to the sampling control signal of the m-th shift register SRm. The forward sampling switch SWf of the precharge circuit 80 is turned on by the sampling control signal of the m-th shift register SRm and the direction selection signal DS. The first to n-th sampling switches SW1 to SWn sample the data signals D1 to Dn that are supplied through the n data buses B1 to Bn and apply the sampled signals to the n data lines DLm1 to DLmn of the m-th pixel block PBm, respectively. The forward sampling switch SWf samples the auxiliary data signal Da supplied through the auxiliary data bus Ba and uses the sampled signal to precharge the first data line DL(m+1)1 of the (m+1)-th pixel block PBm+1. In this case, the data signal that will be supplied to the first data line DL(m+1)1 when the (m+1)-th pixel block PBm+1 is driven is used as the auxiliary data signal Da that is applied to the first data line DL(m+1)1 of the (m+1 )-th pixel block PBm+1 during the precharge process. The (m+1)-th sampling block SBm+1 is driven by the sampling control signal of the (m+1)-th shift register SRm+1 and applies the data signals D1 to Dn to the data lines DL(m+1)1 to DL(m+1)n of the (m+1)-th pixel block PBm+1. In this case, the precharge voltage that was applied when the m-th pixel block PBm was driven is applied to the first data line DL(m+1)1 of the (m+1)-th pixel block PBm+1 during the precharge process.

In the backward driving mode, n sampling switches SWI to SWn of the (m+1)-th sampling block SBm+1 are simultaneously turned on in response to the sampling control signal of the (m+1)-th shift register SRm+1. The backward sampling switch SWb of the precharge circuit 80 is turned on by the sampling control signal of the (m+1)-th shift register SRm+1 and the direction select signal DS. The first to n-th sampling switches SW1 to SWn sample the data signals D1 to Dn that are supplied through the data buses B1 to Bn and apply the sampled signals to the data lines DL(m+1)1 to DL(m+1)n of the (m+1)-th pixel block PBm+1, respectively. The backward sampling switch SWb samples the auxiliary data signal Da supplied through the auxiliary data bus Ba and uses the sampled signal to precharge the last data line DLmn of the m-th pixel block PBm. In this case, the data signal that will be supplied to the last data line DLmn of the m-th pixel block PBm when the m-th pixel block PBm is driven is used as the auxiliary data signal Da for precharging the last data line DLm of the m-th pixel block PBm. The m-th sampling block SBm is driven by the sampling control signal of the m-th shift register SRm and applies the data signals D1 to Dn to the data lines DLm1 to DLmn of the m-th pixel block PBm. In this case, the same data signal that is used to drive the (m+1)-th pixel block PBm+1 is applied to the last data line DLmn of the m-th pixel block PBm during the precharge process.

As described above, the driver of the LCD panel precharges the data line of the adjacent pixel block to the voltage of the current pixel block during the forward and backward driving. Therefore, voltage variation of the pixel electrode positioned at an edge of the pixel block is minimized and a defect in the boundary between the pixel blocks is prevented or reduced.

Figure 4:
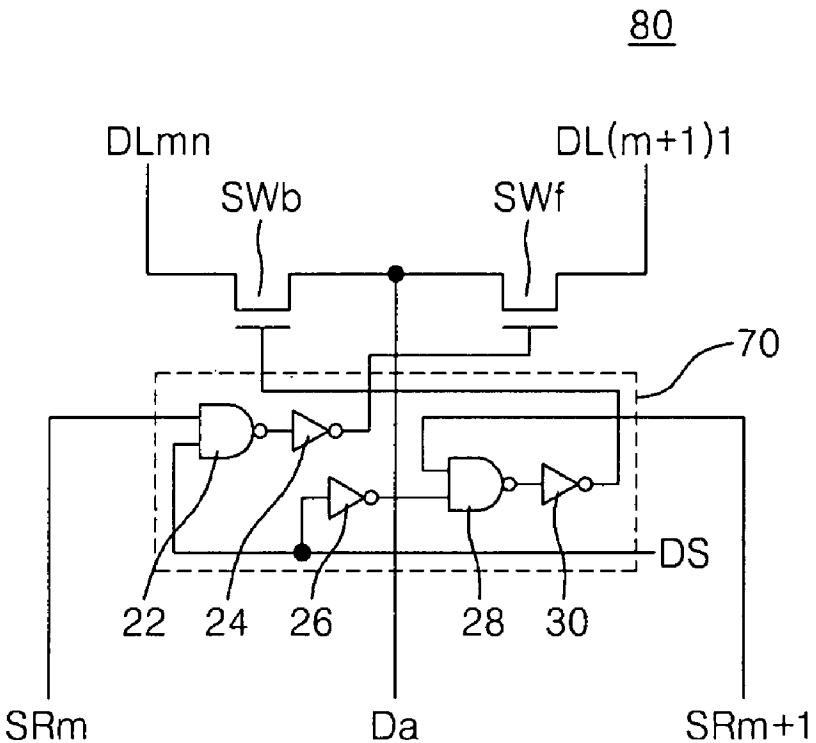
FIG. 4 is a circuit diagram of the precharge controller shown in FIG. 3.

FIG. 4 is a circuit diagram of the precharge circuit 80 shown in FIG. 3.

Referring to FIG. 4, the precharge circuit 80 includes the forward and backward sampling switches SWf and SWb connected commonly to the auxiliary data bus Ba, and the precharge controller 70 for controlling the forward and backward sampling switches SWf and SWb.

The forward sampling switch SWf samples the auxiliary data signal Da from the auxiliary data bus Ba in response to a signal from the precharge controller 70 during the forward driving and applies the sampled signal to the first data line DL(m+1)1 of the (m+1 )-th pixel block PBm+1. The backward sampling switch SWb samples the auxiliary data signal Da from the auxiliary data bus Ba in response to a signal from the precharge controller 70 during the backward driving and applies the sampled signal to the n-th data line DLmn of the m-th pixel block PBm.

The precharge controller 70 controls the backward and forward sampling switches SWb and SWf by performing a logic operation on the sampling control signals of the m-th and (m+1)-th shift registers SRm and the direction selection signal DS. The precharge controller 70 may be implemented with two NAND gates and three inverters. A first NAND operator 22 performs a NAND operation on the sampling control signal of the m-th shift register SRm and the direction selection signal DS. A first inverter 24 inverts the output of the first NAND operator 22 and supplies the inverted output to the forward sampling switch SWf. A second NAND operator 28 performs a NAND operation on the inverted direction selection signal passing through a second inverter 26 and the sampling control signal from the (m+1)-th shift register SRm+1. A third inverter 30 inverts the output of the second NAND operator 28 and supplies the inverted output to the backward sampling switch SWb.

During the forward driving where the sampling control signal of the m-th shift register SRm and the direction selection signal DS are all HIGH, a LOW signal generated through the first NAND operator 22 is inverted to a HIGH through the first inverter 24, thereby turning on the forward sampling switch SWf. The turned-on forward sampling switch SWf samples the auxiliary data signal Da from the auxiliary data bus Ba together with the turned-on m-th sampling block SBm when the n-th pixel block PBm is driven. The forward sampling switch SWf then applies the sampled signal to the first data line DL(m+1)1 of the (m+1)-th pixel block PBm+1.

During the backward driving where the sampling control signal of the (m+1)-th shift register SRm+1 is HIGH and the direction selection signal DS is LOW, the direction selection signal DS that is inverted to HIGH through the second inverter 26 and the HIGH sampling control signal of the (m+1)-th shift register SRm+1 are input to the second NAND operator 28. A LOW signal generated through the second NAND operator 28 is inverted to HIGH through the third inverter 30, thereby turning on the backward sampling switch SWb. The turned-on backward sampling switch SWb samples the auxiliary data signal Da from the auxiliary data bus Ba together with the turned-on (m+1)-th sampling block SBm+1 when the (m+1)-th pixel block PBm+1 is driven. The backward sampling switch SWb then applies the sampled signal to the n-th data line DLmn of the m-th pixel block PBm.

As can be appreciated from the above description, the data driving method and apparatus can minimize the inter-block difference in voltage by precharging the data line in the next pixel block that is adjacent to the current pixel block with the same voltage that is applied to the current pixel block while it is driven. With this method, the voltage difference near an edge of each pixel block can be minimized even during forward or backward sequential driving because the data line that is adjacent to the current pixel block is precharged. As a result of this decreased or eliminated voltage difference, defect at the boundary between the pixel blocks is prevented.

While the present disclosure of invention has been provided with reference to certain embodiments, it will be understood by those skilled in the art after reading the disclosure that various changes in form and details may be made therein without departing from the spirit and scope of the present teachings.

What is claimed is:

1. An image display apparatus comprising:

a liquid crystal display panel including a plurality of data displaying blocks, each of the data displaying blocks having a predetermined number, n of data lines where n is any natural number;

a plurality of n+1 bus lines coupled to provide a corresponding plurality of n+1 data signals; and a data driver having n data input terminals operatively coupled to a corresponding n of the n+1 data bus lines so that the n data terminals can respectively receive the corresponding n data signals which define a to-be displayed image portion that is to be displayed by a selected block among the plural data displaying blocks, the data driver further having an auxiliary data input terminal coupled to receive as a predetermined pre-charge voltage, the $(n+1)^{th}$ one of the n+1 data signals from the $(n+1)^{th}$ one of the n+1 data bus lines, and the data driver further having a plurality of switching blocks respectively connected to respective ones of the plural data displaying blocks, the switching blocks being coupled to be sequentially driven one after the next according to sampling control signals respectively supplied to the switching blocks, wherein each corresponding one of the switching blocks comprises:

n sampling switches responsive to the respective sampling control signal supplied to the corresponding one switching block, the n sampling switches being respectively coupled to receive the corresponding n image-defining data signals from the n data input terminals of the data driver and to selectively supply the received n image-defining data signals to the corresponding one data displaying block in response to the respective sampling control signal supplied to the corresponding one switching block; and a precharge sampling switch that is responsive to the respective sampling control signal supplied to the corresponding one switching block, the precharge sampling switch being coupled to receive the predetermined pre-charge voltage from the auxiliary data input terminal of the driver and to apply, in response to the respective sampling control signal, the predetermined pre-charge voltage to a first data line of a next data displaying block that is to be driven with image-defining signals next after the corresponding one of the data displaying blocks is driven with said n image-defining data signals.

2. The apparatus of claim 1, wherein the predetermined pre-charge voltage is the same as a voltage of a data signal that is next to be supplied to a next adjacent data line of the next to be selectively driven, data displaying block.

3. The apparatus of claim 2, further comprising a plurality of bi-directional shift registers for sequentially supplying the sampling control signal supplied to respective ones of the switching blocks, wherein the plurality of bi-directional shift registers can be driven in a forward or backward direction according to a supplied direction selection signal; and wherein the precharge sampling switch is responsive to the direction selection signal for determining which data line is the next adjacent data line of the next to be selectively driven, data displaying block.

4. The apparatus of claim 3, wherein the pre-charge circuit comprises:

a first sampling switch connected to a next adjacent data line of the next adjacent data displaying block, where the just said next is according to a first of the forward and backward directions;

a second sampling switch connected to a next adjacent data line of the next adjacent data displaying block, where the just said next is according to a second of the forward and backward directions; and a precharge controller structured for connecting a selected one of the first and second sampling switches to the data auxiliary bus in accordance with the direction selection signal.

5. The apparatus of claim 4, wherein the precharge controller comprises:

a first NAND operator for performing a NAND operation on the first sampling control signal and the direction selection signal;

a first inverter for inverting the output of the first NAND operator and controlling the second sampling switch;

a second inverter for inverting the direction selection signal;

a second NAND operator for performing a NAND operation on an inverted direction selection signal exiting the second inverter and the second sampling control signal; and a third inverter for inverting the output of the second NAND operator and controlling the first sampling switch.

* * * * *